United States Patent [19]

Johnson

[11] 4,349,153

[45] Sep. 14, 1982

[54] SPRAY NOZZLE

[75] Inventor: Michael F. Johnson, Toledo, Ohio

[73] Assignee: Champion Spark Plug Company, Toledo, Ohio

[21] Appl. No.: 173,412

[22] Filed: Jul. 29, 1980

[51] Int. Cl.[3] ..... B05B 1/26; B05B 1/28

[52] U.S. Cl. ..... 239/105; 239/296; 239/428.5

[58] Field of Search ..... 239/290, 296, 419, 419.5, 239/422, 424.5, 427.3, 428.5, 526, 527, 105

[56] References Cited

U.S. PATENT DOCUMENTS

| | | | |
|---|---|---|---|
| 2,019,941 | 11/1935 | Tracy | 239/296 |
| 2,646,313 | 7/1953 | Peeps | 239/296 |
| 2,646,314 | 7/1953 | Peeps | 239/296 |
| 3,693,882 | 9/1972 | Watanabe et al. | 239/296 |
| 4,219,157 | 8/1980 | Binoche | 239/296 |

FOREIGN PATENT DOCUMENTS

| | | | |
|---|---|---|---|
| 35394 | 3/1950 | Poland | 239/296 |
| 120292 | 11/1947 | Sweden | 239/296 |

*Primary Examiner*—Robert B. Reeves
*Assistant Examiner*—Michael J. Forman
*Attorney, Agent, or Firm*—Richard D. Emch

[57] ABSTRACT

A spray nozzle is disclosed. The nozzle includes a central opening through which air and material issues. A pair of horns are located on a first center line plane extending through the opening. The outwardly projecting horns include converging air ramps which induce an air flow. The atomizing air openings of the nozzle are positioned outside of opposed sectors which define a predetermined angle and are symmetrical with respect to a center line plane perpendicular to the first diameter. The nozzle limits material deposits and clogging of air openings located in the horns.

5 Claims, 5 Drawing Figures

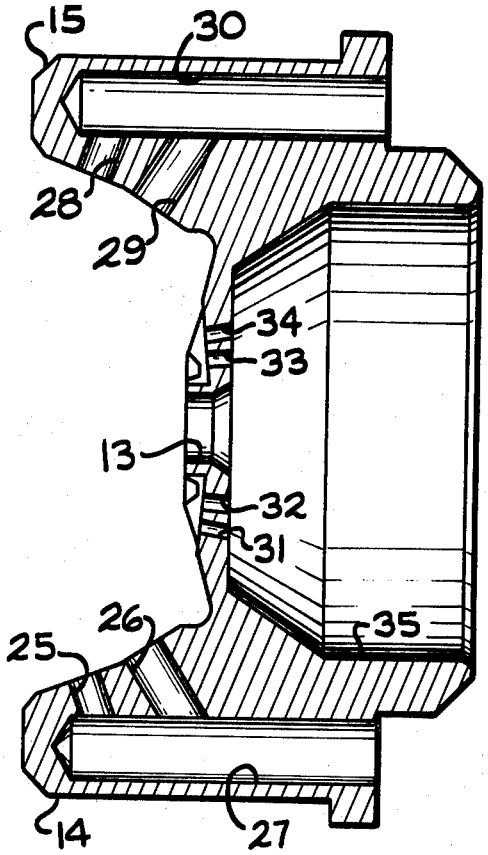
FIG. 3
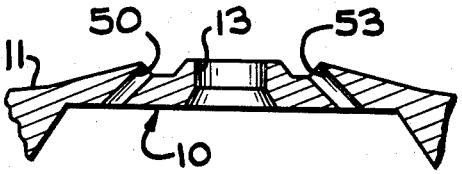
FIG. 4
FIG. 5
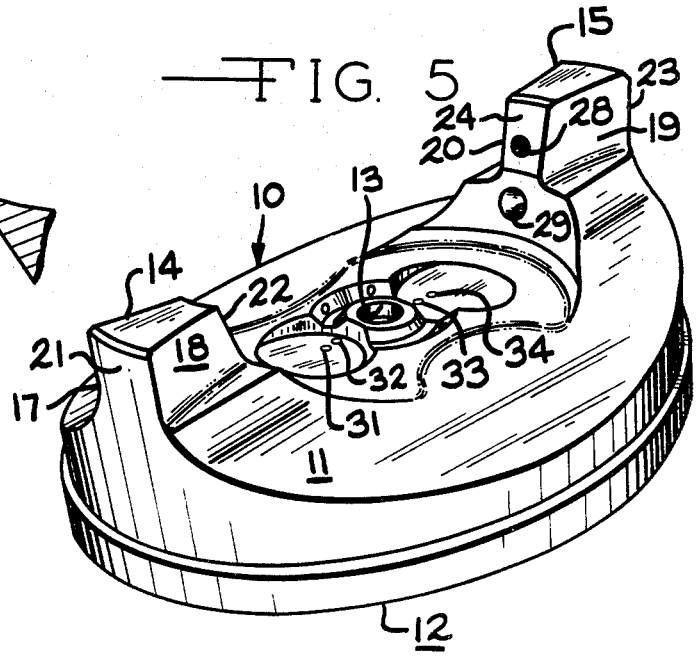

SPRAY NOZZLE

BACKGROUND OF THE INVENTION

The present invention relates to an improved air nozzle for use in spraying a stream of material. The spray nozzle is used, for example, as an air cap on a liquid paint spray gun.

Spray nozzles for paint spray guns are known in the art, for example, refer to FIG. 1 of the drawings. Prior art spray caps normally included a center orifice for the discharge of a stream of paint and air. A pair of horns are positioned on opposite sides of the center orifice. Normally, one or more atomizing openings or jets are positioned adjacent the center orifice along or near a center line plane which is perpendicular to another center line plane extending through the air horns. These atomizing openings allow air jets to penetrate and agitate the mixture of air and paint which is being discharged from the center orifice.

The concentrated mixture which is being dispersed from the orifice is then flattened into a relatively long narrow spray pattern by the combined action of auxiliary jets eminating from auxiliary openings and also horn jets eminating from openings in each of the air horns.

It has been found that problems sometimes arise with prior art spray nozzles when the atomizing jets strike the central material air stream. The atomizing jets tend to splash material laterally towards the air horns. The material, for example, paint, is deposited on the horns adjacent to the horn jets and eventually tends to clog these jets.

When this occurs, the spraying operation must be stopped and the spray nozzle removed and replaced. In production line situations, this time is significant. If the spray cap deposition rate, which is normally measured in milligrams/minute can be reduced, the economic benefit is great.

The present improved spray nozzle includes converging air ramps on the horn projections of the spray cap. The converging ramps induce a greater air flow directed towards the center of the spray nozzle. This induced air flow apparently deflects coating particles moving outwardly towards the air horns, greatly reducing undesired paint deposits on the air horns.

It has also been found that if the atomizing air openings are excluded from angular sectors adjacent a center line plane perpendicular to the center line plane extending through the air horns and center orifice, the unwanted deposition of paint is again significantly reduced.

It is therefore the primary object of the present invention to provide an improved spray nozzle which lowers the deposition rate of paint on portions of the nozzle and greatly increases the length of time in which a spray line can be operated prior to shut down for removal, cleaning, or replacement of the spray gun cap.

Further objects of the present invention will be apparent from the following drawings and specification.

DETAILED DESCRIPTION OF THE DRAWINGS

FIG. 3 is a cross-sectional view of the improved spray nozzle, according to the invention, taken along line 3—3 of FIG. 2;

FIG. 4 is a fragmentary cross-sectional view taken along the line 4—4 of FIG. 2; and FIG. 5 is a perspective view of the improved spray nozzle, according to the present invention.

DESCRIPTION OF THE PREFERRED EMBODIMENT

Figure 1:
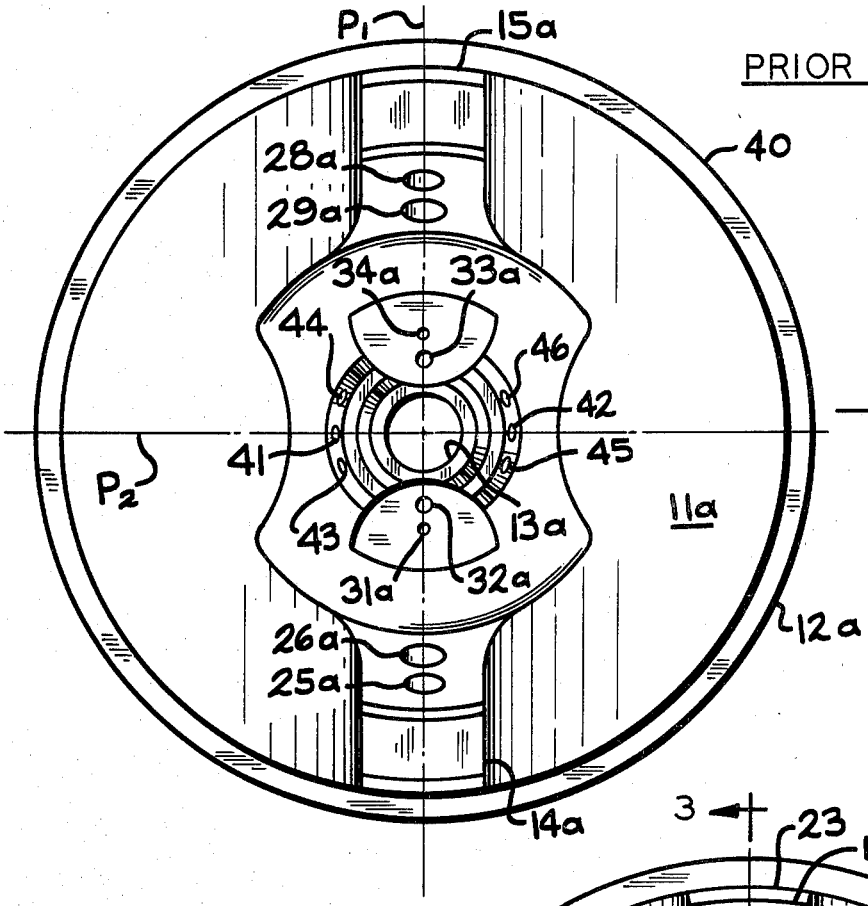
FIG. 1 is a front view of a prior art spray nozzle.

An improved spray nozzle, according to the present invention, is indicated in the drawings by the reference number 10. The spray nozzle 10 has a body 11 which defines a peripheral shoulder 12 and a central opening or orifice 13. In the preferred embodiment, the central opening 13 has a diameter of 0.125 inches. The spray nozzle 10 is mounted on, for example, a liquid paint spray gun and material, such as paint is discharged through the central opening 13 along with a stream of air. A pair of horns 14 and 15 project outwardly and are symmetrical with respect to a plane $P_1$ which extends through the center opening 13. As shown in FIG. 5, the horns 14 and 15 project forwardly of the discharge central opening 13. Each of the horns 14 and 15 define a pair of air ramps, designated 17–18 and 19–20 respectively. The air ramps 17–18 extend from an outer surface 21 to an inner surface 22 of the horns 14. Similarly, the air ramps 19–20 extend from an outer surface 23 towards an inner surface 24 of the horn 15. The air ramps 17–18 and 19–20 converge inwardly toward one another as they approach their respective inner surfaces 22 and 24.

The horns 14 and 15 each define two air openings. The horn 14 defines openings 25 and 26 which are in communication with an air passageway 27. Similarly, the horn 15 defines openings 28 and 29 which are in communication with an air passageway 30.

In the embodiment shown in FIGS. 2–5, auxiliary air openings 31, 32, 33 and 34 extend through the body 11 and communicate with a central passageway 35. In the embodiment shown, all of the air openings 25–26, 28–30, and 31–34 are aligned in the center line plane of the horns 14 and 15, having their center lines located on the plane $P_1$.

Referring to FIG. 1, a prior art spray nozzle is shown and designated by the reference number 40. The spray nozzle 40 is manufactured by the DeVilbiss Company and is designated as a 777 cap. The spray nozzle 40 is similar to the improved spray nozzle 10 and includes a body **11*a* having a shoulder 12*a*; a central opening 13*a*; and a pair of outwardly projecting horns 14*a* and 15*a*. The horns define horn jets 25*a*, 26*a*, 28*a* and 29*a*. The prior art spray nozzle 40 also includes auxiliary air openings designated 31*a*, 32*a*, 33*a*, and 34*a*. All of the air openings have their center lines positioned along the center line plane $P_1$ which extends through the central passageway 13*a*.**

Figure 2:
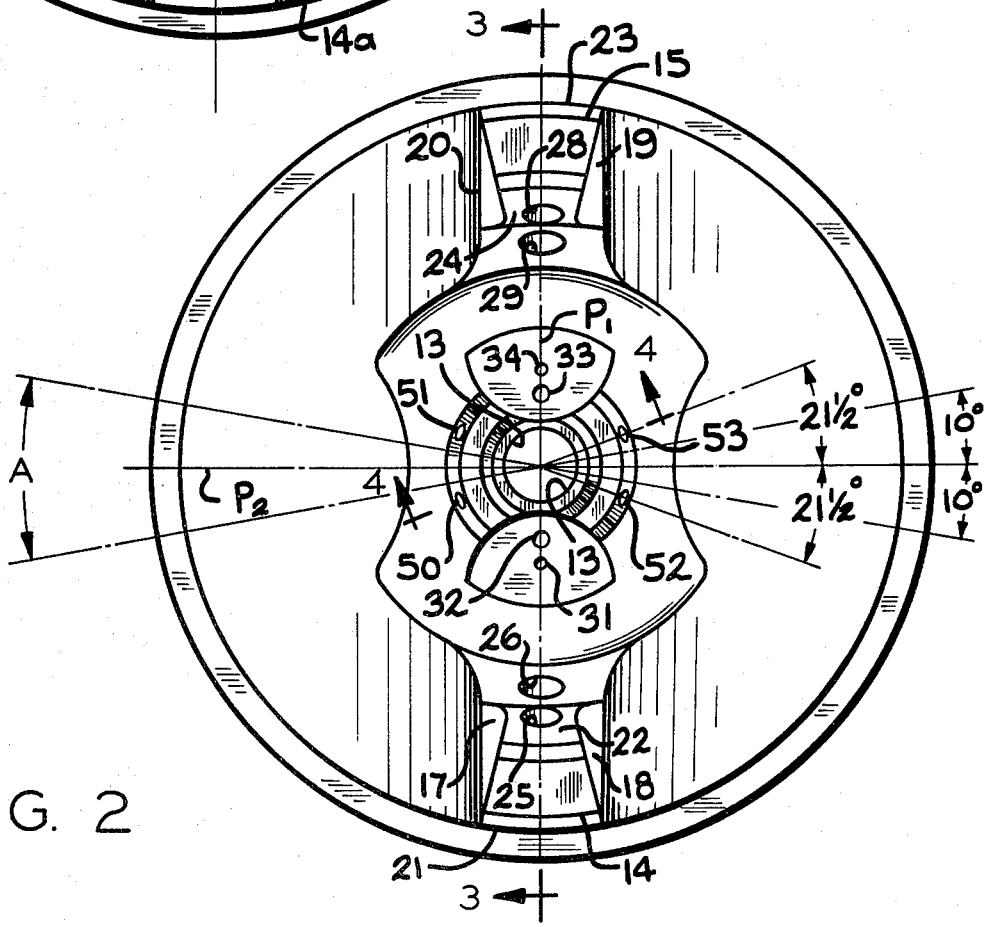
FIG. 2 is a front view, similar to FIG. 1, showing the improved spray nozzle of the present invention.

In FIGS. 1 and 2, a plane perpendicular to the center line plane $P_1$, also extending along the center lines of the central openings 13 and **13*a*, respectively, has been designated $P_2$. Referring to the prior art spray nozzle 40, a pair of opposed atomizing air openings 41 and 42 are defined along the perpendicular plane $P_2$. The prior art nozzle 40 also includes additional atomizing air openings 43 and 44, which are each $21\frac{1}{2}°$ removed from the plane $P_2$ and the atomizing air opening 41. Additional atomizing air openings 45 and 46 are located on the opposed side adjacent the atomizing air opening 42** which is also located on the perpendicular plane $P_2$.

Referring to FIG. 2, a sector is shown having its apex at the center of the central opening 13. The sector is symmetrically positioned with respect to the perpendicular plane $P_2$. The radii of the sector defines a predetermined angle designated as "A" in FIG. 2. In the improved spray nozzle 10, pairs of atomizing air openings 50–51 and 52–53 are defined through the body 11 on opposed sides of the central opening 13. Each of the atomizing air openings, of the improved spray nozzle, are located outside of the sector defined by the predetermined angle "A". It has been found that the predetermined angle "A" which defines the sector should be at least 20°. In the embodiment shown in the drawings, each pair of atomizing air openings 50–51 and 52–53 are positioned on radii which define an angle of 43°. Each of the atomizing air openings 50–53 are spaced an angle of 21½° from the perpendicular plane $P_2$.

Referring to the prior art spray nozzle 40, a pair of opposed atomizing air openings 41 and 42 are defined along the perpendicular plane $P_2$. The prior art nozzle 40 also includes additional atomizing air openings 43 and 44, which are each 21½° removed from the plane $P_2$ and the atomizing air opening 41, together with atomizing air openings 45 and 46 located on the opposed side adjacent the atomizing air opening 42 also located on the perpendicular plane $P_2$.

In both the prior art spray gun 40 shown in FIG. 1 and in the improved spray nozzle 10, primary atomizing air and paint issues from the center orifice 13. As mentioned above, the atomizing openings 50–53, which in the preferred embodiment (see FIG. 4) are positioned at a 45° angle with respect to the center line axis of the orifice 13, admit atomizing jets which contact the air-paint material to further atomize and propel the mixture toward the work piece. The air jets 25–26, 28–29 and 31–34, wherein the first four openings are horn jets, shape the paint-air mixture into the desired relatively long narrow spray pattern.

In many prior art spray nozzles, for example, the DeVilbiss 777 spray nozzle illustrated in FIG. 1, the atomizing air jets tend to splash paint or other material laterally outward towards the horn projections 14*a* and 15*a* as the air streams strike the central material-air eminating from the central opening 13*a*. This causes a deposit on the spray nozzle 40 which tends to particularly encroach upon the horn air jets 25*a*–26*a* and 28*a*–29*a* and eventually clog such openings.

In the improved spray nozzle 10, the air ramps 17–20, induce an air flow down such ramps towards the center of the spray nozzle 10. These air flows then apparently deflect away paint particles traveling towards the horn from the center air-paint stream. Similarly, the exclusion of atomizing openings from the opposed sectors defined by the predetermined angle "A", also aids in reducing the cap deposition rate. The cap deposition rate is the amount of paint deposited on the spray nozzle or spray cap over a period of time.

The results obtained by the spray nozzle 10 compared to the prior art spray nozzle 40 are totally unexpected. In an industrial or commercial spray painting operation, the length of time in which a spray nozzle can be operated, prior to shutting down the line for cleaning or replacement is extremely important. A 50% improvement in the cap deposition rate would be meaningful in an industrial production line paint spraying operation. On the next page of the present specification, is shown TABLE I. The table is for illustration purposes only and is shown to give an overall relative cap deposition rate between the prior art DeVilbiss' 777 Spray Nozzle designated as spray nozzle 40 in FIG. 1 and the improved spray nozzle. The test results are not meant to be absolute and could vary under testing at different times or when using different materials.

Referring to FIG. 1, the cap deposition rate in milligrams per minute for the prior art 777 spray nozzle was 0.58, while the cap deposition rate for the improved spray nozzle was 0.06. This great improvement in the cap deposition rate is unexpected. The present improved spray nozzle 10 has been found to be an extremely well received nozzle in the marketplace, particularly in production line situations.

TABLE I

| | Material - 24 sec. #4 Ford cup orange air dry enamel | |
|---|---|---|
| | 777 SPRAY NOZZLE(1) | IMPROVED SPRAY NOZZLE(2) |
| Air pressure at gun PSIG | 50 | 50 |
| Air flow SCFM | 15 | 15 |
| Fluid Pressure PSIG | 11 | 11 |
| Fluid Flow - FF tip Gram/Minute | 670 | 675 |
| Pattern length at 7" distance & 70 psi air | 14½ | 14¼ |
| Total amount of paint sprayed - grams | 3350 | 6750 |
| Paint deposited on cap milligrams | 2.9 | 0.6 |
| Duration of spray test in minutes | 5 | 10(3) |
| Cap deposition rate in milligrams/min. | .58 | .06 |

(1)Center Opening - .120 inches.
(2)Center Opening - .125 inches.
(3)Longer time required for enough paint to be deposited on cap to be weighable.

What I claim is:

1. A spray nozzle for spraying apparatus using air for atomization, said nozzle having a center orifice for the discharge of a stream of material and air, a pair of horns on opposed sides of such center orifice and extending outwardly therefrom, a plurality of atomizing openings adjacent said center orifice for aiding in the atomization of such material, a plurality of openings aligned with said horns for discharging air to engage and shape said material and air mixture into a desired spray pattern, at least one of said openings being located in each of said horns, each of said horns defining a pair of air ramps extending from the outer surface of each of said horns to the inner surface of said horn, the bottom surface of each of said air ramps extending from said outer surface of said horn to said inner surface of said horn, said bottom surface of each of said air ramps being generally parallel to the main surface of said nozzle, said air ramps on the opposite sides of each of said horns converging toward one another as they approach such inner surface, whereby during operation an air flow is induced towards the center orifice to deflect material particles away from the horns.

2. A spray nozzle, according to claim 1, wherein said horns are symmetrical with respect to a first center line plane of said center orifice which extends through said opposed horns and wherein opposed sectors are symmetrical about a second center line plane perpendicular to said first plane, said sector radii of each of said sectors defining a predetermined angle, said atomizing openings being located outside of said opposed sectors, said spray nozzle having no atomizing openings located within said opposed sectors.

3. A spray nozzle, according to claim 2, wherein said predetermined angle is at least 20°.

4. A spray nozzle, according to claim 2, wherein said spray nozzle has four atomizing openings, each of said atomizing openings being located on a radius which defines an angle of $21\frac{1}{2}°$ with such perpendicular second plane.

5. A liquid paint spray nozzle comprising, in combination, a base defining a center orifice, a pair of horns symmetrically located on a first center line plane which extends through the center line of such center orifice, said pair of horns being opposed from one another and extending outwardly from such center orifice, a plurality of atomizing openings defined by said base and located outside of opposed sectors having their apexes the center of such center orifice, said opposed sectors being symmetrical about a second center line plane perpendicular to said first plane, said spray nozzle having no atomizing openings located within said opposed sectors, each of said opposed sectors defining an angle of at least 20°, a plurality of auxiliary air openings located adjacent said first plane, at least one of said air openings being located in each of said horns, each of said horns defining a pair of air ramps extending from the outer surface of each of said horns to the inner surface of said horn, the bottom surface of each of said air ramps extending from said outer surface of said horn to said inner surface of said horn, said bottom surface of each of said air ramps being generally parallel to the main surface of said nozzle, said air ramps on the opposite sides of each of said horns converging toward one another as they approach such inner surface, whereby during operation an air flow is induced towards the center orifice to deflect paint particles away from the horns.

* * * * *